United States Patent [19]

Ortner et al.

[11] 4,351,633

[45] Sep. 28, 1982

[54] METHOD OF RECOVERING THE SENSIBLE HEAT OF CONTINUOUSLY CAST SLABS

[75] Inventors: Artur Ortner; Rudolf Zeller, both of Linz, Austria

[73] Assignee: Voest-Alpine Aktiengesellschaft, Linz, Austria

[21] Appl. No.: 193,548

[22] Filed: Oct. 3, 1980

[30] Foreign Application Priority Data

Oct. 18, 1979 [AT] Austria ..... 6790/79

[51] Int. Cl.³ ..... F27D 15/02

[52] U.S. Cl. ..... 432/77; 34/13; 165/96; 266/259

[58] Field of Search ..... 432/77, 85; 34/13; 165/96; 266/259; 122/20 B

[56] References Cited

U.S. PATENT DOCUMENTS

| | | | |
|---|---|---|---|
| 1,778,747 | 10/1930 | Barnebey et al. | 432/85 |
| 3,285,706 | 11/1966 | Cake | 432/85 |
| 3,892,391 | 7/1975 | Okuno | 266/259 |
| 3,957,111 | 5/1976 | Kobayashi et al. | 432/77 |
| 4,211,187 | 7/1980 | Farris | 122/20 B |
| 4,256,606 | 3/1981 | Noack et al. | 432/77 |

FOREIGN PATENT DOCUMENTS

| | | | |
|---|---|---|---|
| 2311603 | 5/1976 | France . | |
| 52-77847 | 7/1977 | Japan | 122/20 B |
| 432057 | 8/1975 | U.S.S.R. | 432/77 |

*Primary Examiner*—John J. Camby

*Attorney, Agent, or Firm*—Brumbaugh, Graves, Donohue & Raymond

[57] ABSTRACT

In a plant for recovering the sensible heat of continuously cast slabs, the slabs are guided through a cooling chamber in which heat is given off from the slabs to a cooling medium. In order to achieve a high heat yield and a low exit temperature of the slabs, the cooling medium is brought into direct contact with the slab surfaces within the cooling chamber, and the heated cooling medium is used as a heating medium in a heat exchanger in contact with a recirculating medium.

7 Claims, 3 Drawing Figures

FIG. 1
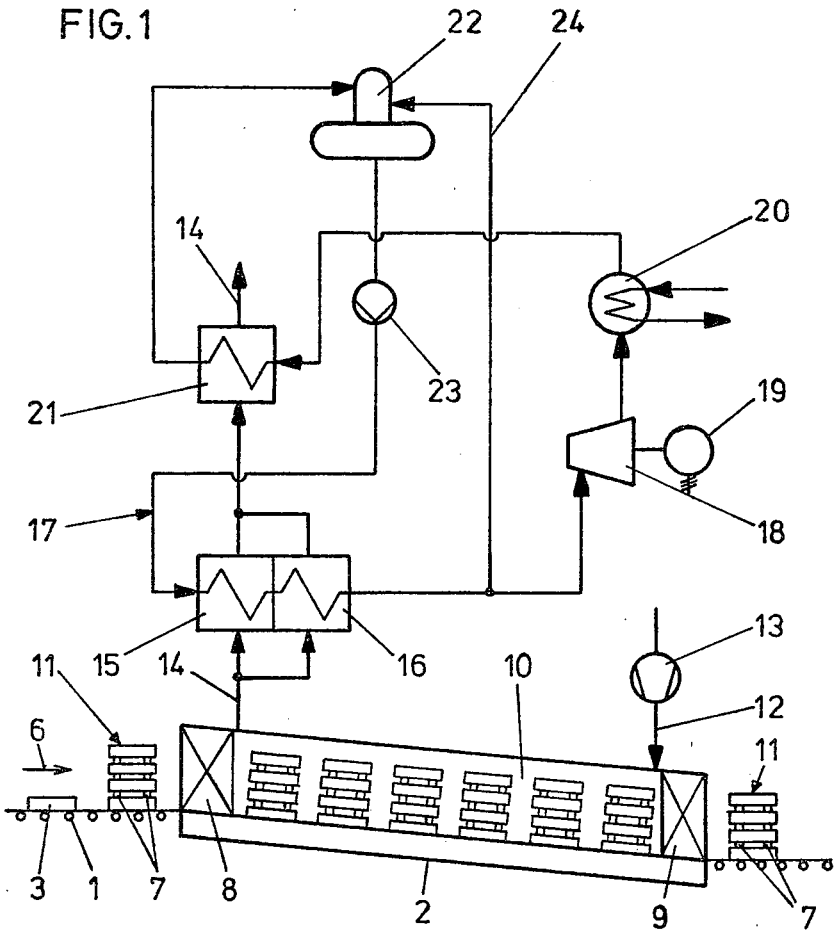
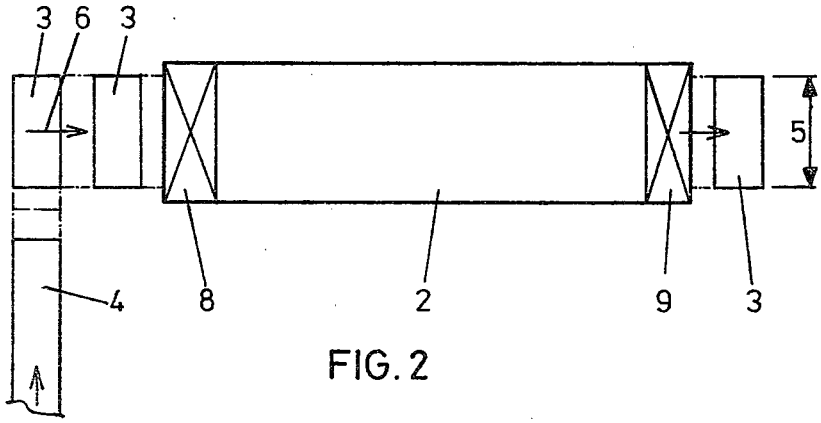
FIG. 2

METHOD OF RECOVERING THE SENSIBLE HEAT OF CONTINUOUSLY CAST SLABS

BACKGROUND OF THE INVENTION

The invention relates to a method of and plants for recovering the sensible heat of slabs cast by the continuous casting method, wherein the slabs, after having been sheared to length, are guided through a cooling chamber within which heat is given off by the slabs to a cooling medium.

Since the rolling of continuously cast slabs into plates takes place discontinuously, it is necessary to store the continuously cast slabs in an intermediate storage room. In this intermediate storage room the slabs cool down to ambient temperature.

In order to utilize the sensible heat of the slabs, it is known to guide the slabs through a cooling chamber before their intermediate storage, within which chamber boiler pipes are arranged, through which a cooling medium, such as water, flows. This cooling medium is heated in the boiler pipes by heat radiated from the slabs. The steam that forms serves for the self-supply of heat for the steel making plant. With this known method the heat is supplied from the slabs to the cooling medium via the boiler pipes by radiation alone.

Since heat transmission by radiation is only efficient in the upper temperature regions of the slabs, i.e. between 900° and 600° C., the slabs that emerge from the cooling chamber, with this known method, have a temperature of more than 400° C. If it were desired to lower the exit temperature of the slabs to below 400° C., it would be necessary to increase the dwell time of the slabs within the cooling chamber by a multiple. Since the slabs are produced continuously, it would be necessary to either arrange several cooling chambers parallelly adjacent one another or to provide one cooling chamber of an extreme length. A low slab exit-temperature of below 400° C., in particular of 150° to 200° C., not only is important because of the greater heat yield, but is also essential in order to allow the intermediate storage room to be designed as small as possible—the slabs can be piled more closely together when they have lower temperatures—and in order to achieve the shortest intermediate storage times.

SUMMARY OF THE INVENTION

The invention aims at avoiding these disadvantages and difficulties and has as its object to provide a method as well as a plant for carrying out the method, by which a higher heat yield from the heat of the slabs can be achieved, while the dwell time of the slabs within the cooling chamber remains within tolerable limits so that a relatively small and accordingly economical cooling chamber will suffice.

This object is achieved according to the invention in that the cooling medium within the cooling chamber is brought into direct contact with the slab surfaces and the heated cooling medium outside the cooling chamber is used as a heating medium, in particular for a circulatory medium conducted in a thermodynamic circulatory process.

Preferably, air is conducted as the cooling medium through the cooling chamber, whereby too abrupt a cooling of the slabs is prevented, despite a low slab exit-temperature and a short cooling chamber.

According to another preferred variant, water is sprayed as the cooling medium onto the surface of the slabs within the cooling chamber. The steam that forms is sucked out of the cooling chamber, and the heat of the steam is used for heating up water, whereby it is possible to keep the cooling chamber particularly short and the slab exit-temperature particularly low. This variant is of advantage in case of certain steel qualities that can stand an abrupt cooling-off.

Suitably, the steam which has been condensed after giving off the heat to the water is conducted in circulation.

A plant for carrying out the method according to the invention, comprising a cooling chamber provided with entry and exit locks and a transporting means for the slabs within the cooling chamber, is characterized in that in the region of the exit lock of the cooling chamber there enters an air inlet conduit which is connected to a fan, and at the other end of the cooling chamber in the region of the entry lock there is connected an air exhaust conduit.

Suitably, a heat exchanger for heating up water is provided in the air exhaust conduit, which heat exchanger is connected in a conduit-like manner with a turbine and a condenser via a closed steam circulatory system, wherein the turbine may serve as a drive for a generator.

For a better heat yield from the air emerging from the cooling chamber, a further heat exchanger for preheating the feed water is arranged in the air exhaust conduit so as to follow the heat exchanger.

In order to be able to design the cooling chamber particularly short, i.e. so as to occupy little floor space, the height of the cooling chamber is a multiple of the height of the slabs and the transporting means accommodates slabs piled one above the other in a spaced-apart manner.

According to a preferred embodiment, a plant for carrying out the method according to the invention comprises a cooling chamber and a transporting means for the slabs within the cooling chamber. This plant is characterized in that at least one water supply conduit including spraying nozzles is provided in the cooling chamber, and on the ceiling of the cooling chamber there is provided a steam exhaust conduit in which a heat exchanger for heating water is located.

Advantageously, a return conduit follows the heat exchanger so as to direct the water from the steam that has been condensed in the heat exchanger into the water supply conduit, whereby the cooling water that is sprayed onto the slabs can be conducted in circulation.

For feeding back the water that does not evaporate during spraying, a water discharge running into the water supply conduit is suitably provided in the bottom of the cooling chamber.

BRIEF DESCRIPTION OF THE DRAWINGS

The invention will be explained in more detail in the following, with reference to the accompanying drawings, wherein:

FIG. 1 is a schematic plan of a cooling chamber according to the present invention with air being provided as the cooling medium;

FIG. 2 shows the ground plan of the cooling chamber schematically illustrated in FIG. 1.

DESCRIPTION OF ILLUSTRATIVE EMBODIMENTS

Figure 3:
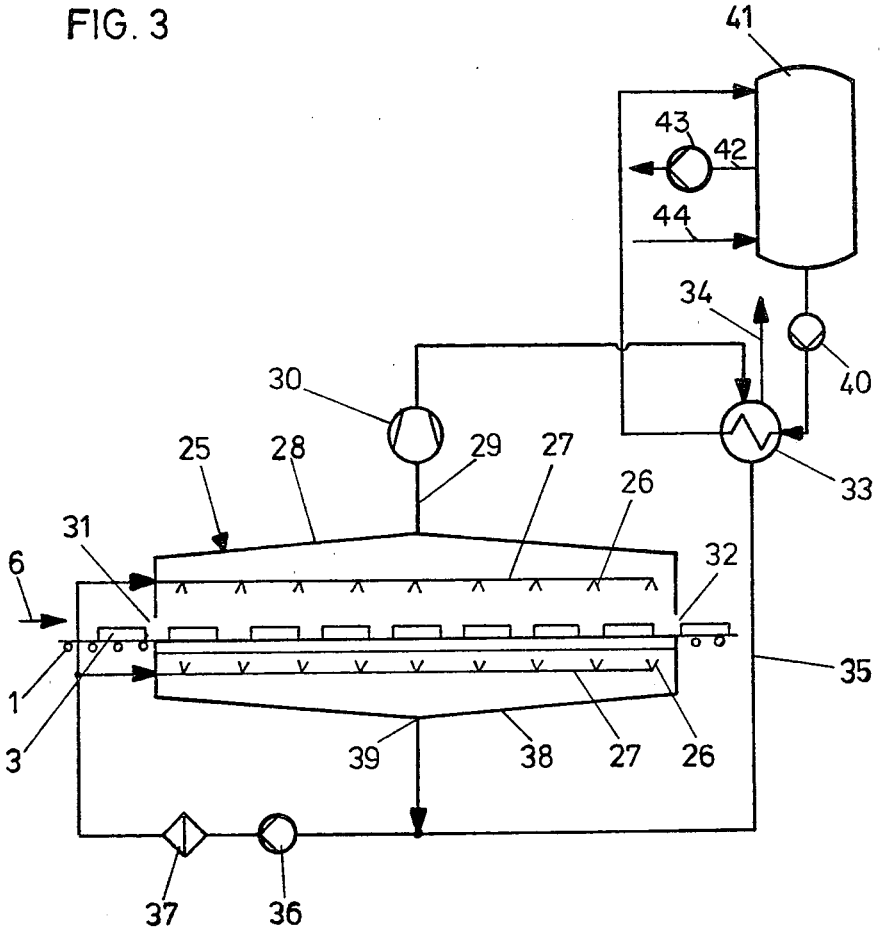
FIG. 3 is a schematic plan, in an illustration analogous to FIG. 1, with water being provided as the cooling medium.

Slabs 3, which are conveyed to a cooling chamber 2 by a conveying means, for instance a roller way 1, are divided from the cast strand 4 into pieces of a predetermined length 5.

The slabs 3 are conveyed to the cooling chamber 2 transversely to their longitudinal direction (in the direction of arrow 6). Before entering the cooling chamber the slabs 3 are piled on each other, but are held at a distance from each other by spacers 7 inserted between them so as to form slab piler 11. The piling may be effected by a tong crane or by similar lifting means.

The cooling chamber 2 has an entry lock 8 and an exit lock 9 for sealing the interior 10 of the cooling chamber from the external air during the introduction and removal of the slab piles 11. These locks 8, 9 are equipped with either lifting doors or swinging doors. The slab piles 11 are moved within the cooling chamber by a conveying means (not illustrated in detail). The transportation of the piles may be realized by various systems, e.g. by means of walking beams or by means of roller carriages with externally arranged rollers, or by means of a roller way.

As is schematically illustrated in FIG. 1, the cooling chamber 2 is slanted downwardly in the run-through direction of the slabs 3 in order to make the transportation of the slab piles 11 easier. In the region of the exit lock 9, an air inlet conduit 12 runs into the cooling chamber, through which air is blown into the interior 10 of the cooling chamber 2 by means of a fan 13. In the region of the entry lock 8 an air exhaust conduit 14 is provided, in which heat exchangers 15, 16 are arranged. These heat exchangers serve for producing steam of the water that is conducted in the closed steam circulatory system 17. The steam emerging from the heat exchangers 15, 16 is supplied to a turbine 18 driving a generator 19. From the turbine the released steam is supplied to a condenser 20. The water emerging from the condenser is supplied to a feed water container 22 including a degasser, via a further heat exchanger 21 which is arranged after the first-mentioned heat exchangers 15, 16 in the air exhaust conduit 14. By means of a pump 23 the water is supplied from the feed water container to the heat exchangers. Part of the steam is supplied via a conduit 24 to the feed water container for preheating the feed water. This steam circulation corresponds to that of a usual small caloric power station.

In the embodiment illustrated in FIG. 1, the slabs enter the cooling chamber 2 with a temperature of about 900° C., and have a temperature of only 250° C. when leaving the cooling chamber. The heat amount introduced into the cooling chamber 2 by the slabs amounts to 30,000 kJ, whereas the heat emerging with the slabs is 9,000 kJ. For the fan an external power of about 630 kW is required. A total of 5,300 kJ is approximately the loss of heat due to the locks and the air entering the environment after leaving heat exchanger 21. The condenser 20 causes a heat loss of about 10,900 kJ. The output of the generator is about 4,800 kW.

Since the water entering the heat exchanger 15 has a temperature of 100° to 120° C. the air that is used as the heating medium can only be cooled down to a certain temperature that depends on the design of the heat exchanger. In order to be able to better utilize the heat content of the air, a heat exchanger 21 arranged after the heat exchangers 15, 16 the air exhaust conduit 14 is provided. The entrance temperature of the water at this heat exchanger 21 is considerably lower (about 40° C.) so that the air can still be further cooled down. The air emerging from heat exchanger 21 and still having a temperature higher than that of the ambient air, can either be given off to the atmosphere (FIG. 1, open circulation) or fed back to the suction side of the fan 13, thus forming a closed circulation.

Instead of the steam production, the heat amount conducted away from the cooling chamber by the air could also be utilized for other purposes, e.g. this air could be used for the preparation of hot water, for drying purposes or also as preheated combustion air for a boiler plant.

In the embodiment illustrated in FIG. 3 the slabs 3 are also conveyed, transversely to their longitudinal axis in the direction of arrow 6, through a cooling chamber 25. However, the slabs lie one beside the other in one plane. They are sprayed with water coming from water supply conduits 27 that are equipped with spraying nozzles 26. These spraying nozzles are arranged both on the upper sides of the slabs 3 and near the lower sides of the slabs. The steam forming in the cooling chamber is sucked off at the ceiling 28 through a steam suction conduit 29 by means of a fan 30. Through this steam suction conduit, also ambient air is sucked along, which enters at both ends 31, 32 of the cooling chamber 25. Since the cooling chamber is under a slight vacuum due to the fan 30, it is not necessary to provide locks at the ends 31, 32. The steam-air mixture is supplied, via the steam suction conduit 29, to a heat exchanger 33 in which the steam is condensed. The air that has also been sucked off enters the open air through a conduit 34. The condensed steam in the heat exchanger is supplied to the water supply conduits 27 via a return conduit 35, a pump 36 and a filter 37. The water entering the atmosphere through conduit 34 together with the air have to be replace. In the bottom 38 of the cooling chamber a water discharge 39 is provided through which the sprayed water that has not been transformed into steam is also fed back to the return conduit 35.

The heat exchanger 33 serves for heating water which is conducted in circulation by means of a pump 40 via a hot-water tank 41. From the hot-water tank, hot water having a temperature of from 55° to 85° C. can be withdrawn by pump 43 through conduit 42, for instance for use in a floorheating. The entrance temperature of the water fed back in conduit 44 from the floor heating into the hot-water tank 41 amounts to about 30° C. Assuming an entrance temperature of the slabs 3 of 900° C. with a heat amount of 30,000 kJ and an exit temperature of the slabs 3 of 150° C. with a heat amount of 3,500 kJ and a heat loss of about 1,000 kJ, a usable heat amount of 25,500 kJ will result. For the fan 30, an exterior power of 100 kW is required.

What we claim is:

1. In a plant for recovering the sensible heat of continuously cast slabs, of the type including a cooling chamber having an entry lock and an exit lock and transporting means for transporting the slabs, after having been sheared to length, through said cooling chamber, the improvement comprising an inlet conduit running into said cooling chamber in the region of said exit lock for delivering a first fluid medium into direct contact with the slabs in said cooling chamber, an exhaust conduit connected to said cooling chamber in the region of said entry lock for removing the first fluid medium from said cooling chamber, a first heat exchanger provided in said exhaust conduit for transferring the heat of the first fluid medium to a second fluid medium, means for moving the first fluid medium through said inlet and exhaust conduits, means for utilizing the heat of said second fluid medium, and means for recirculating said second medium between said heat exchanger and said means for utilizing.

2. A plant as set forth in claim 1, wherein said first fluid medium is air, said second fluid medium is water, said means for moving the first fluid medium is a fan, said first heat exchanger provided in said exhaust conduit heats up the water to form steam, said means for utilizing is a turbine driven by the steam and a condensor for converting the steam back to water, and said heat exchanger is connected with said turbine and said condenser in a conduit-like manner via a closed steam circulatory system.

3. A plant as set forth in claim 2, further comprising a second heat exchanger arranged to follow said first heat exchanger in said exhaust conduit, said second heat exchanger utilizing the air in said exhaust conduit to preheat the water from said condensor.

4. A plant as set forth in claim 1, wherein the height of said cooling chamber is a multiple of the height of said slabs, and wherein slab piles are accommodated by said transporting means, said slab piles being formed by a plurality of slab piled one above the other in a spaced-apart manner.

5. A plant for recovering the sensible heat of continuously cast slabs as claimed in claim 1, wherein said cooling chamber has a ceiling and a floor, said first fluid medium is water as it enters the cooling chamber and steam as it leaves the cooling chamber, said second fluid medium is water, said inlet conduit is at least one water supply conduit including spraying nozzles provided in said cooling chamber, said exhaust conduit is a steam exhaust conduit provided in the ceiling of said cooling chamber, and said heat exchanger provided in said steam exhaust conduit heats up the water of said second fluid medium.

6. A plant as set forth in claim 5 wherein said recirculating means includes a return conduit arranged after said heat exchanger and provided for the steam condensed into water in said heat exchanger, said return conduit running into said water supply conduit.

7. A plant as set forth in claim 5 or 6, further comprising a water discharge provided in said floor of said cooling chamber and running into said water supply conduit.

* * * * *